United States Patent [19]

West

[11] 4,143,672

[45] Mar. 13, 1979

[54] ANTI-POLLUTION VALVE FOR USE WITH SHIPBOARD STORAGE TANKS

[75] Inventor: Harold H. West, Seattle, Wash.

[73] Assignee: APV Corporation, Seattle, Wash.

[21] Appl. No.: 808,653

[22] Filed: Jun. 21, 1977

[51] Int. Cl.[2] ..... B63B 25/10

[52] U.S. Cl. ..... 137/81; 114/212; 137/599; 251/73

[58] Field of Search ..... 114/212; 137/81, 599; 251/73

[56] References Cited

U.S. PATENT DOCUMENTS

| | | | |
|---|---|---|---|
| 2,873,754 | 2/1959 | Dunaway | 137/81 |
| 3,868,921 | 3/1975 | Seymour et al. | 114/212 X |

*Primary Examiner*—Robert G. Nilson

*Attorney, Agent, or Firm*—Seed, Berry, Vernon & Baynham

[57] ABSTRACT

A valve unit for installation in a vent to atmosphere from an upper end of a shipboard storage tank for liquids. The valve has a housing with a closure seat, a normally open closure member, and an actuator for automatically closing the closure member against the seat to prevent the passage of liquids out from the tank if and when the ship sinks. The actuator includes a sealed reference chamber and a restricted orifice leading into a housing surrounding the sealed chamber, so that if the ship sinks, water enters the orifice, fills the housing around the sealed chamber and exerts pressure substantially greater than that inside the sealed reference chamber. A trigger is actuated by movement resulting from the pressure in the housing exceeding that inside the reference chamber. The invention also provides for a safety by-pass. A by-pass conduit leads around the closure seat, and a relief valve in the by-pass conduit opens only when the pressure in the main valve, i.e., below the closure seat is a predetermined amount higher than the pressure in the vent conduit above the closure seat. The by-pass conduit is in a housing that is freely detachable from the valve housing and which is secured to it by a pivotally mounted locking clamp device. Detachment results in mechanical locking of the closure member against its seat and also enables salvage of the contents with either positive or negative pressure after the ship has sunk.

9 Claims, 9 Drawing Figures

ANTI-POLLUTION VALVE FOR USE WITH SHIPBOARD STORAGE TANKS

BACKGROUND OF THE INVENTION

This invention relates to an improved valve for use with a normally vented liquid storage tank for ships. The invention is an improvement over the valve shown in U.S. Pat. No. 3,868,921.

The principles of the invention described in U.S. Pat. No. 3,868,921 are sound, and the form of the invention shown there is a good form. However, certain new problems have become important, and many of the aspects of the earlier invention can be improved.

For example, while the ship is afloat, there is a possibility of the main valve becoming inadvertently closed during filling or ballasting. This could be caused by an inexpert operator closing the valve manually under the mistaken impression that he was opening it, or for some other reason. It is important that the pressure in the tank not be so great that it could damage or break the tank. Hence, it is an object of the present invention to provide a by-pass means that prevents the building up of damaging internal pressures in the tank if the main valve is inadvertently closed during filling or ballasting.

When there is a by-pass such as the present invention provides, it is important that this not be a source of leakage, and therefore it is an object of the present invention to provide a by-pass system having a relief valve which is kept closed with sufficient pressure to retain the cargo but does not damage the tank structure if the ship does sink. The main clapper valve can still act as a low-pressure check valve allowing flow into the tank if the ship is underwater, while precluding an accidental closure that would seal the tank to outside pressure. Furthermore, when salvage operations are conducted, it is desirable to have the clapper valve held positively closed. Hence, that also is provided for herein.

The pressure reference chamber shown in U.S. Pat. No. 3,868,921 is open to the atmosphere, and therefore there is a possibility that under certain circumstances the valve might be actuated even though the ship does not sink, or the actuating device might fail to operate upon sinking of the ship, because seawater has corroded parts, so that parts of the valve would seize and remain unmovable. It is therefore an object of the present invention to provide a sealed pressure reference chamber, the internal pressure of which cannot be altered, as by water filling a non-sealed chamber, and yet which provides for closing the valve when subjected to the same general conditions as close the valve shown in U.S. Pat. No. 3,868,921.

Another object is to protect the restricted orifice into the non-sealed chamber, so that it will not become plugged and then fail to admit fluid. Periodic inspections are desirable, but periodic replacement of parts are expensive. Thus, where elastomeric gaskets are used for packing for seals and where other short-life parts are used, maintenance becomes a major factor. So another object of the present invention is to provide a valve capable of satisfactory operation though constructed completely from metal and not requiring any use of elastomers. Moreover, another object of the invention is to provide for simple checking of the operability of the valve.

Another object of the invention is to provide for sure retention of the valve clapper by eliminating vulnerable small fasteners such as pins, cotter pins, or snap rings, and providing instead more reliable structure.

Additional objects and advantages of the invention will appear from the following description of a preferred embodiment, since some of these objects and advantages cannot be explained clearly until the structure of the valve itself has been described.

SUMMARY OF THE INVENTION

The invention provides a valve for a shipboard storage tank for liquids. The valve is installed in a vent conduit leading from an upper end of the storage tank to an outlet open to the atmosphere. A valve housing contains a closure seat aligned with the vent conduit and a spring-urged closure member or clapper for automatically closing against the seat when the ship sinks, to prevent the passage of liquids from the tank to the outlet. A latching arrangement normally holds the closure member in open position so as not to interfere with the normal venting and overflow functions of the vent. This latching arrangement is unlatched upon the valve's reaching a predetermined depth in the water when the ship sinks.

The unlatching is achieved by the effect of the water pressure exerted, upon sinking, on a sealed reference chamber. This chamber is provided by an outer bellows plate, an inner bellows plate, and two concentric bellows sealed to both plates, the annular space between the bellows containing gas at a predetermined reference pressure. A bellows housing is spaced away from the bellows and from the outer bellows plate and is seated against the inner bellows plate. A passage leads in from the atmosphere via a restricted orifice into the space surrounding the bellows. Thus, an increase in pressure in said space surrounding the bellows compresses them and urges the outer bellows plate toward the inner bellows plate.

The restricted orifice is constructed to be freed from clogging matter by normal tossing and pitching of the ship, so that it will not fail to admit water when and if the ship sinks.

A trigger device is operatively connected to the outer bellows plate and engages the closure member so as to retain it in its latched position, but when the pressure in the bellows housing exceeds a predetermined amount, the trigger device is moved to where it releases its latch, and the valve closes.

There is a by-pass around the closure seat leading from below the closure seat to above it. A relief valve in the by-pass conduit opens only when the pressure below the closure seat is a predetermined amount higher than the pressure above it.

The by-pass housing is freely detachable from the valve housing, for a pair of locking clamps are pivotally mounted so as to lock the by-pass housing snugly in place on the valve housing. When the clamp is pivoted away from its locked position, the whole by-pass housing can be removed, as for salvage operation. At that time a latch automatically locks the valve closure member in its closed position, while the relief valve is removed to give access to the liquid cargo in the tank.

DESCRIPTION OF A PREFERRED EMBODIMENT

Figure 1:
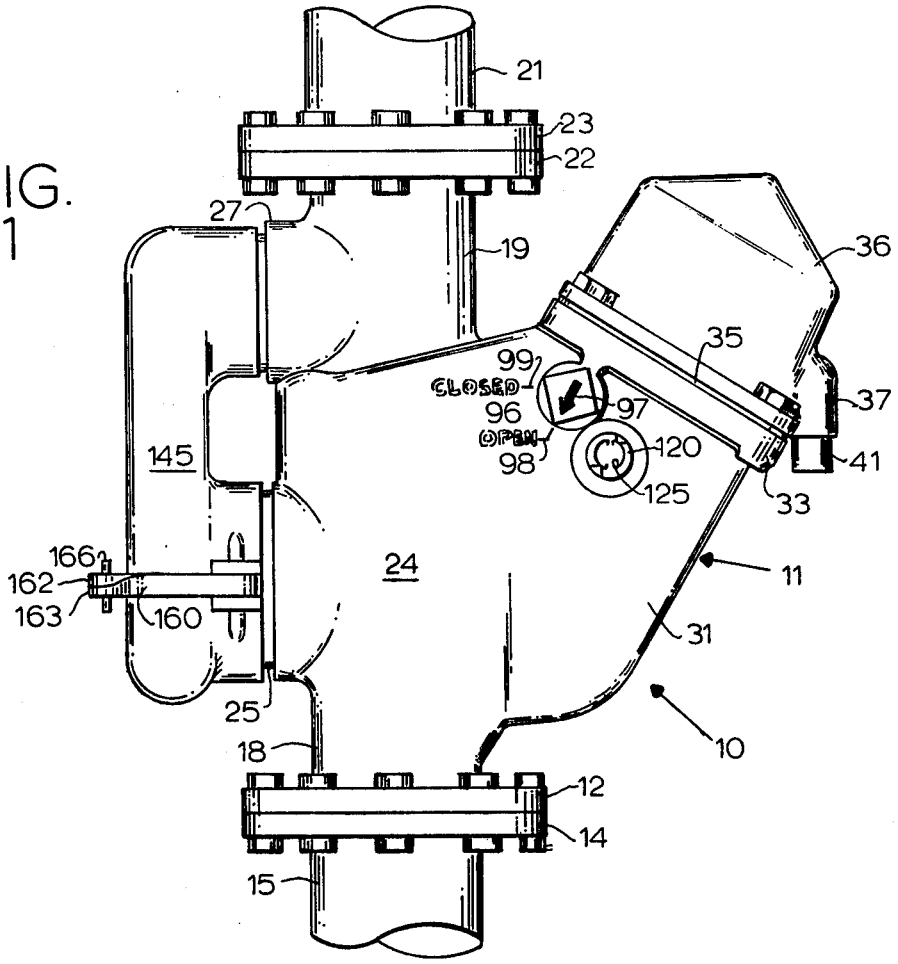
FIG. 1 is a view in side elevation of a valve embodying the principles of the invention. The valve is shown installed in place, with the conduit to the storage tank and the conduit leading to the vent broken off. The valve is in its open position, the normal position for a ship afloat.
Figure 2:
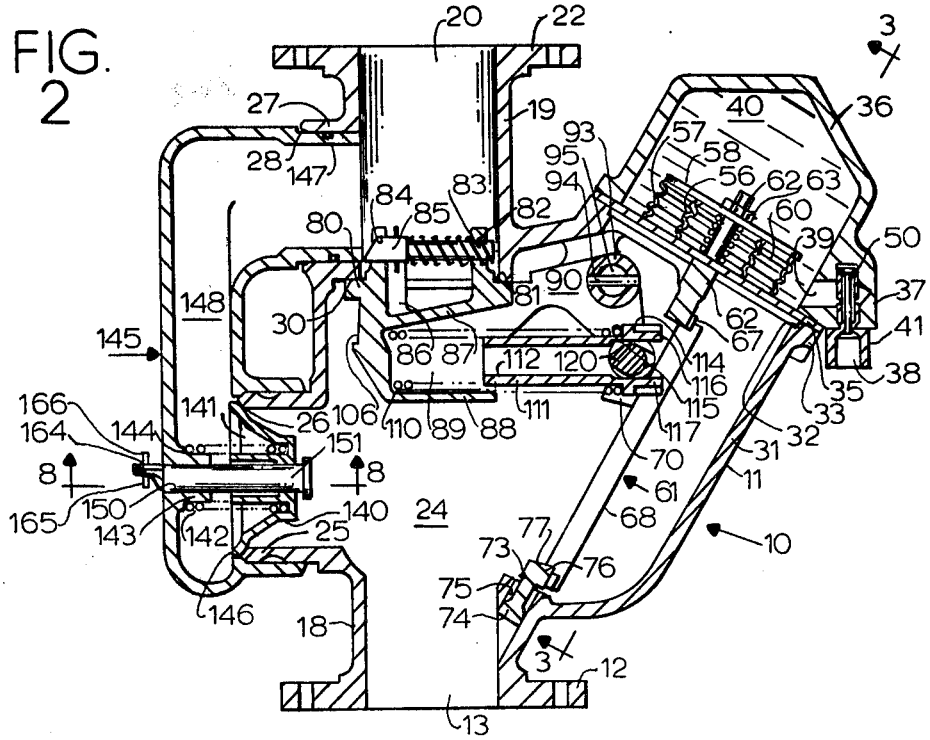
FIG. 2 is a view in vertical section of the valve of FIG. 1 in the closed position, as when the ship has sunk or as when the valve is tested for operability.
Figure 9:
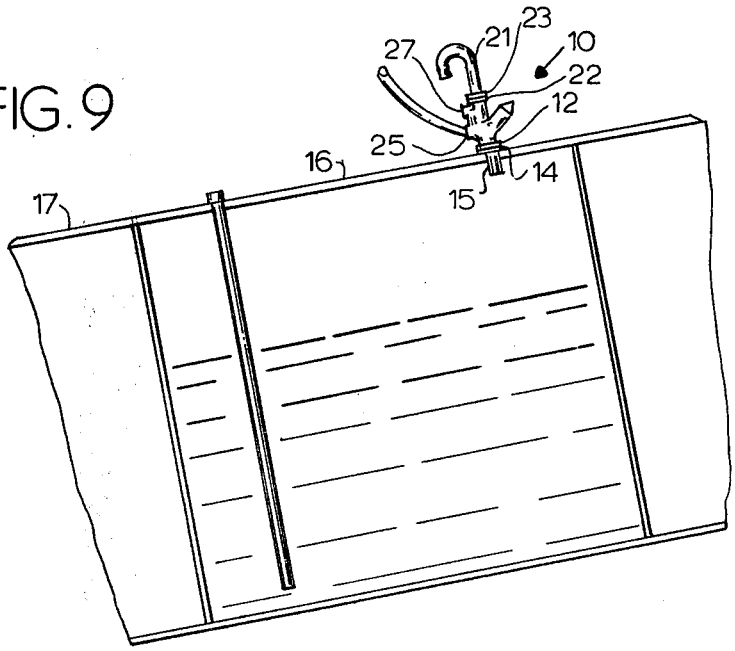
FIG. 9 is a somewhat diagrammatic fragmentary view of a portion of a submerged ship, with a tank having the valve of FIG. 1 arranged for salvage operation.

A valve 10 embodying the principles of the present invention is shown in FIGS. 1 and 2 and comprises a unitary machined casting or body 11. Preferably all the valve parts are made from metal, though at least some of them may be made from plastic. The casting or body 11 is provided with an integral lower flange 12 which surrounds an inlet 13. The flange 12 is secured to a flange 14 on a conduit 15 (FIG. 1) leading from a tank 16 of a ship 17 (FIG. 9) which is to be protected by the valve 10. In line with the opening of the inlet 13 (See FIG. 2) are a lower conduit portion 18, an upper conduit portion 19 spaced apart from the conduit portion 18, and an outlet 20 at the upper end of the body 11, which leads into a vent conduit 21 (FIG. 1). The outlet 20 is therefore surrounded by a flange 22 which is bolted to a similar flange 23 on the conduit 21. Between the lower conduit portion 18 and the upper conduit portion 19 is an enlarged open portion 24 of the valve body 11, at one side of which is a by-pass and salvage conduit portion 25 and outlet 26. Attached to the upper conduit portion 19 is a by-pass conduit portion 27 and port 28. Just below the by-pass conduit portion 27 and well above the salvage conduit portion 25 is an annular main valve seat 30. Opposite the by-pass and salvage conduit 25, the body 11 is provided with an angularly extending, rather oval extension 31 terminating in a large opening 32 and a flange 33.

Figures 3, 4, 5, 6:
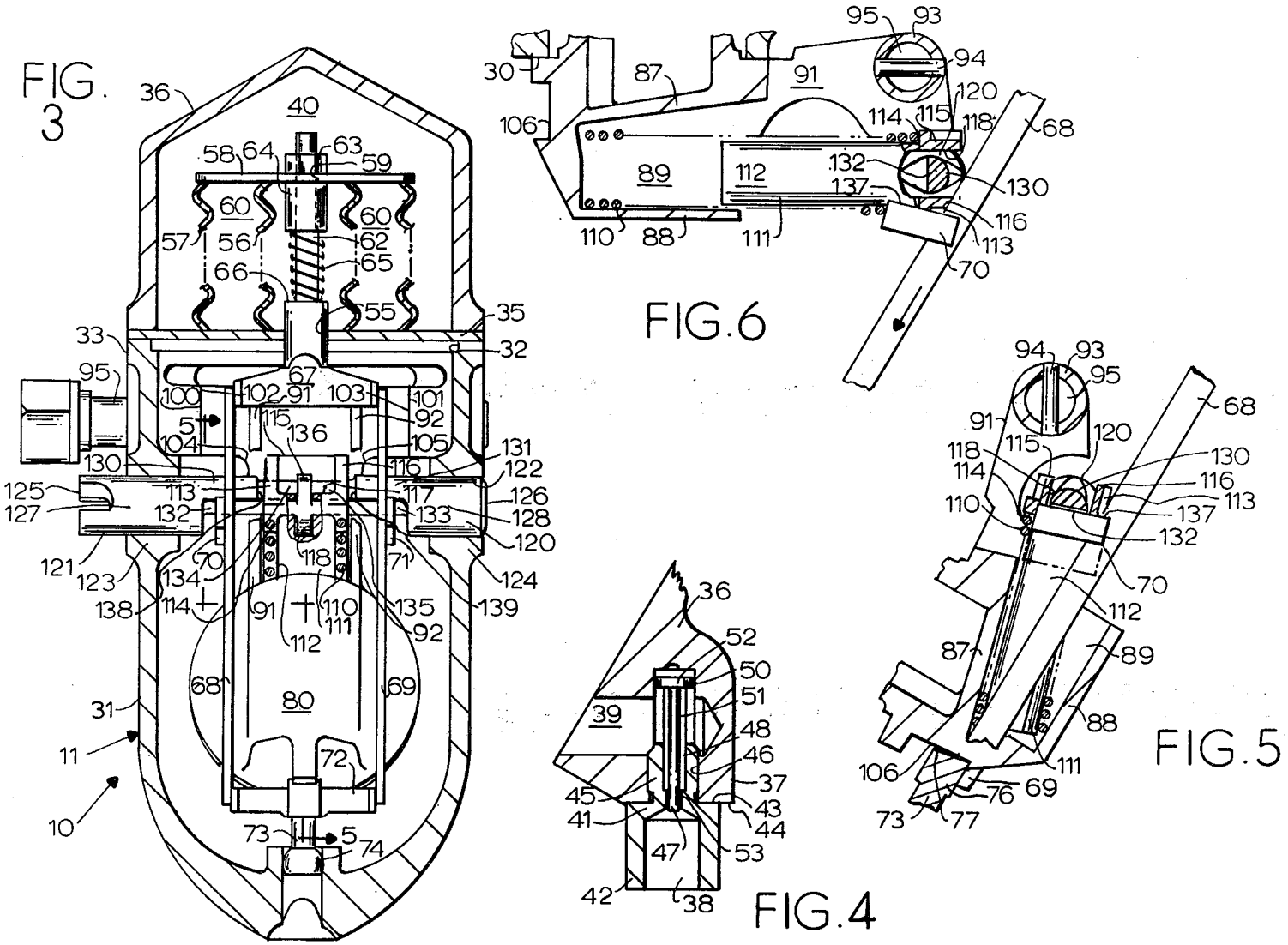
FIG. 3 is a view in section taken along the line 3—3 in FIG. 2, with the valve in open position, as in FIG. 1.
FIG. 4 is a fragmentary view in section enlarged from a portion of FIG. 2, showing the actuating inlet and orifice.
FIG. 5 is a fragmentary view in section of the trigger and associated parts, taken along the line 5—5 in FIG. 3.
FIG. 6 is a similar view with the same parts in their valve-closed position.

The large opening 32 is closed off by a lower bellows plate 35 and a bellows-enclosure cover 36 that are bolted to the flange 33 (See FIGS. 2 and 3). The cover 36 includes a bossed portion 37 having an inlet opening 38 leading in from outside to pass air or water via a conduit 39 into a bellows-surrounding chamber 40. The conduit 39 (See FIG. 4) is provided by a fitting 41 having an enlarged portion 42, with a shoulder 43 abutting a portion 44 of the cover 37, and a smaller diameter portion 45 fitting in a bore 46 of the cover 36 and either threaded or press-fit thereto. A reduced-diameter passage 47 leads from the enlarged inlet portion 38 to a larger passage 48 that opens into the passage 39.

A loose member 50 has a metering pin 51 that is substantially smaller in diameter than the reduced-diameter passage 47 and has an enlarged head 52. The clearance between the metering pin 51 and the reduced-diameter passage 47 provides an orifice 53 which serves to prevent ephemeral effects from substantially influencing the pressure within the chamber 40, while also serving to admit water under pressure if and when the vessel sinks. The metering pin 51 is purposely retained loosely, so that it will be moved by ship vibrations being transmitted to the valve 10. This movement reduces the possibility that the orifice 53 might become clogged by the accumulation of salt or paint.

An important part of the invention is the system by which the valve 10 is actuated and by which the actuation can be governed by a sealed chamber. For this purpose there is a novel bellows assembly comprising the lower plate 35, which is secured in between the bellows cover 36 and the main body 11. This plate 35 has a central opening 55 therethrough. To the plate 35 are welded (or otherwise sealed) two concentric bellows members, an inner bellows member 56 and an outer bellows member 57, and these members 56 and 57 are also welded (or otherwise sealed) to the upper bellows plate 58, which is movable by extension or retraction of the bellows 56 and 57. The plate 58 is provided with a small central opening 59. The chamber 40 outside the outer bellows 57 is an empty space which is in communication with the external atmosphere via the orifice 53. The bellows 56 and 57 may be made of bronze, as may the two plates 35 and 58. A sealed chamber 60 in between the two bellows 56 and 57 may be charged with dry air or preferably with nitrogen at atmospheric pressure, for example, 14.7 psia. The bellows 56 and 57 may have, as a typical figure, a maximum mechanical spring rate of about 24 pounds per inch and an effective minimum area of about 14 square inches.

The orifice 53 is small enough so that one wave, although it might send some water into the chamber 40, which would soon drain out, is not able to apply sufficient force to build up substantial pressure in the chamber 40 around the outer bellows 57. On the other hand, if the ship sinks, water will pass through the orifice 53 and will, in adequate time, build up pressure in the chamber 40 outside the outer bellows 57 and against the upper bellows plate 58 sufficient to compress the two bellows 56 and 57, moving the upper plate 58 toward the lower plate 35. As will be seen below, this will result in triggering the closing of a clapper valve 80.

A trigger assembly 61 comprises a shaft or trigger stem 62 having a threaded upper end that projects through the opening 59 in the upper bellows plate 58 and a nut 63 is threaded on the protruding end of the shaft 62. A sleeve 64 encircles the shaft 62 rather snugly below the upper bellows plate 58 and is thrust against the plate 25 by a spring 65 that bears against it and also against a shoulder 66 on the shaft 62, so that there is little or no leakage through the opening 59. The upper bellows plate 58 can move down toward the lower plate 35, thereby moving the trigger shaft 62 downwardly. The spring 65 exerts enough pressure to enable the movement of the plate 58 to release the trigger assembly 61, and it enables adjustment of the device to a desired water depth for effecting release of the trigger.

The bellows assembly seals off the chamber 40 from the interior of the valve body 11. However, even if the vessel were to sink to a depth great enough to crush and rupture the bellows 56 and 57, the only cargo loss could be that which could seep through the small orifice 53.

The trigger shaft 62 extends through the opening 55 in the lower bellows plate 35 and into the housing 11. At its lower end, is a (preferably integral) transverse bar 67 from the outer ends of which extend two offset longitudinal bars 68 and 69. These bars 68 and 69 each carry an inclined short lug 70,71. The lower ends of the bars 68 and 69 are joined to a transverse bar 72 that is part of a short shaft 73 with a ball-like terminal end 74. The end 74 extends into a passage 75 in the housing 11. Opposite the short shaft 73 is a trigger member 76 having a sloping face 77. The trigger assembly 61 may be cast as a single piece or may be made by welding small pieces together.

Figure 7:
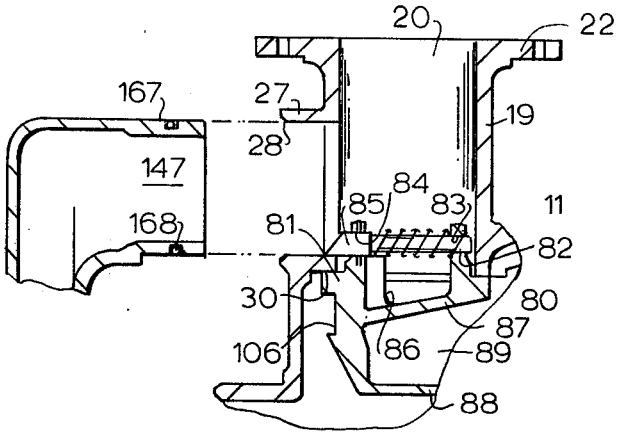
FIG. 7 is a fragmentary view in elevation with the by-pass housing just removed for salvage, whereupon a latch locked the clapper valve in its closed position.

The clapper valve 80 (FIGS. 2, 3, and 7) is provided with a closure ring 81 which surrounds a cylindrical portion 82 and which seats against the seat 30, if and when the clapper valve 80 is released from its normally locked position, as will be explained below. The cylindrical portion 82 is provided with two diametrically opposite openings 83 and 84 for cooperation with a latch 85, as will be explained. Below the annular seating portion or sealing ring 81 of the valve 80 there is a small cavity 86 in line with the cylindrical portion 82 and closed off at its lower end by a wall 87. This helps to keep the valve 80 light-in-weight and so reduces its inertia. Depending from the cylindrical portion 82 is a transverse wall 88 defining a spring cavity 89. The clapper valve 80 also has a lever portion 90, preferably integral therewith, comprising two arms 91 and 92 that extend out to one side and terminate in a cylindrical sleeve portion 93 having opposite diametrical openings for reception of a pin 94 which secures the clapper sleeve 93 to a clapper shaft 95.

The shaft 95 extends transversely across the valve body portion 31, and out through two openings on opposite sides of the body portion 31. The shaft 95 includes a head 96 preferably having a cast raised arrow 97 to show the actual position of the shaft 95 and therefore of the valve 80. The body portion 31 itself is marked with two indices 98 and 99 to indicate whether the arrow 97 is pointing to the open position 98 or the closed position of the clapper 80. The open position 98 is the normal one, the valve 80 being in the closed position 99 in the event that the vessel 17 sinks or when closure of the valve 10 is being tested.

The clapper 80 is retained axially in position in the valve body 11 by the ends 100 and 101 of the sleeve 93 abutting like ends of bosses 102 and 103 of the body 11, and the arms 91 and 92 axially retain a spring carrier 111, described below. There are also bosses 104 and 105. The clapper 80 also has a very important notch 106 for engagement with the trigger member 76. The nut 63 and the spring 65 provide a means for connecting the trigger assembly 61 to the bellows plate 58. The spring force is much greater than that possible to generate with the bellows; so the movable plate 58 of the bellows assembly is always against the nut 63. The position of the nut 63 on the trigger stem 62 determines the length of the bellows when the trigger member 76 is in the clapper notch 106 and thereby the pressure required on the bellows for release of the clapper 80. This provides for an adjustment (at the time of assembly) of the water depth at which the valve 10 closes.

The clapper 80 and shaft 95 rotate together when the clapper 80 is moved from the open position to the closed position, or vice versa, and the rotation relative to the housing 11 is free.

The clapper 80 is urged toward its closed position (when the trigger 61 is released) by a spring 110, which is mounted around a sleeve-like spring carrier 111 that extends into the spring cavity 89 of the clapper 80. The spring 111 and carrier 112 are trapped in place by the configuration of the parts related to them. Normally, the clapper 80 is retained in open position by the trigger assembly 61, in a manner now to be explained.

The spring carrier 111 has a spring-surrounded sleeve portion 112 and a head 113 providing a shoulder 114 for the spring 110 to bear against. The head 113 has two parallel portions 115 and 116 joined by a transverse portion 117 having a slot 118. The spring carrier 111 is retained in place partly by the adjacency of the walls 115 and 116 to the lever arms 91 and 92 of the clapper 80.

The spring carrier 111 is rotatably mounted on a release shaft 120 of somewhat unusual form extending between and rotatably in two in-line openings 121 and 122 in respective bosses 123 and 124 on opposite sides of the housing portion 31. At one end the release shaft 120 has a right-hand helical key 125 (FIGS. 1 and 3) and the other end 126 is cylindrical. Adjacent these two ends 125 and 126 the shaft 120 has respective cylindrical portions 127 and 128, between which it has semicircular portions 130 and 131 with respective flat surfaces 132 and 133 and inner further-reduced semicircular portions 134 and 135 on opposite sides of a central rather diamond-shaped tongue 136. The tongue 136 extends in and through the slot 118. The flat faces 132 and 133 are normally engaged by a flat face 137 of the notch 118 in the spring carrier 111, and the release shaft 120 is normally thereby prevented from rotating. The faces 138 and 139 at the end of the semicircular portions 134 and 135 axially retain the shaft 120.

When the pressure exerted against the bellows plate 58 and the spring 65 exceeds a pre-set amount as happens when water under pressure fills the chamber 40, the trigger 61 is moved downwardly out of engagement with the notch 106 in the clapper 80, and the spring 110 then snaps the clapper 80 closed against the seat 30.

The release shaft 120 is detented by its flats to a rotational position with relation to the spring carrier 111. The lugs 70 and 71, when contacted by the edge of the flats on the shaft 120 force the trigger assembly 61 downward and move the trigger member 76 out of engagement with the notch 106 of the clapper 80 as the shaft 120 is rotated for manual or test release. They also prohibit the spring action of the bellows from lifting the trigger 61 so far that the slope adjacent to the notch 106 in the clapper 80 could not contact the slope 77 on the trigger member 76 and force it downwardly to engage the notch 106 as the clapper 80 is rotated from closed to the "cocked" position. When the clapper 80 is in the "cocked" position, the lugs 70 and 71 are clear of the shaft 120 and the trigger movement toward the bellows is stopped by the bottom of the notch 106 in the clapper 80.

The structure described eliminates the need for vulnerable small fasteners such as pins, cotter-pins, and snap rings.

It should be noted that the release shaft 120 has multiple functions. It supports the clapper spring reaction by supporting the spring carrier 111. Its key 125 enables the insertion of a tool which can turn the shaft 120 forcibly against the detenting action of the spring 110 and the pressure of the bellows 56 and 57 forcing the trigger 61 out of engagement with the notch 106 in the clapper 80, so that the clapper closure can be tested. The shaft 120 restricts the bars 68 and 69 against rotation, thereby keeping the trigger assembly 61 oriented. The interaction of the spring carrier 111 with the flats 132 and 133 on the shaft 120 utilizes the clapper spring 110 to power a detent action keeping the shaft 120 rotated to the proper position after manual release for testing. The diamond configuration of the tongue 136 on the shaft 120 in the slot 118 at the center of the spring carrier 111 prevents inadvertent manual rotation of the shaft 120 beyond the detent action. An extension of the detent flats 132, 133 on the shaft 120 acts as a cam when the shaft 120 is manually rotated against the lugs 70 and 71 to force the trigger 61 and trigger member 76 axially downward out of engagement with the notch 106 of the clapper 80.

The manual release wrench key 125 on the end of the shaft 120 is a one-way configuration to prevent the rotation of the shaft 120 as the clapper 80 closes from pulling the wrench around with it and possibly injuring the hand of the individual testing the valve 10. The unlatching rotation is in the same direction as that through which the shaft 120 turns when the clapper 80 closes upon actual actuation by overcoming the pressure of the bellows 56 and 57.

Manual closure of the clapper 80 is useful not only for testing but also for enabling the retention of cargo and to aid in vessel buoyancy. For example, when a vessel is grounded or stranded and is only partially submerged, the clapper 80 can be manually closed to prevent the liquid cargo from being forced out through the vent passage 20 by wave action, even when there has been a rupture of the tank. Such closure also assists in keeping the disabled ship afloat or in helping it to be refloated, even though a lower portion of the tank may be ruptured, for upon closure, air remains trapped at the top of the tank and is held in, up to the pressure at which by-pass is caused, as described below, instead of the air being displaced by incoming seawater or by oil lifted by incoming seawater.

When the clapper 80 is closed, it is normally able to open when the pressure above it exceeds the pressure below it, and this is desirable to prevent the breaking up of the tank 16 or of the ship 17. However, when the tanks 16 are being salvaged so that the liquid cargo is taken out (See FIG. 9), the clapper 80 should be held rigidly in place, and for this purpose the latch 85 is provided. However, the latch 85 is normally prevented from being actuated, by the presence of a by-pass assembly, a preferred form of which is now about to be described.

On the opposite side of the valve housing 11 from the extension 31 enclosing clapper actuating mechanism is the by-pass opening 26. This opening 26 is normally kept closed by a by-pass valve 140 which is shaped to fit against and into the opening 126 and conduit portion 125 and which is also provided on its opposite side with a spring-receiving recess 141. A spring 142 in the recess 141 bears against the valve 140 at one end, and its opposite end encircles a cylindrical portion 143 and bears against a shoulder 142 on a by-pass housing 145, which is a casting having a lower opening 146 and an upper opening 147 joined by a closed passage 148. The by-pass housing 145 also has a through opening 150 in line with the valve 140 to receive a mounting and retaining shaft 151 for the valve 140.

Figure 8:
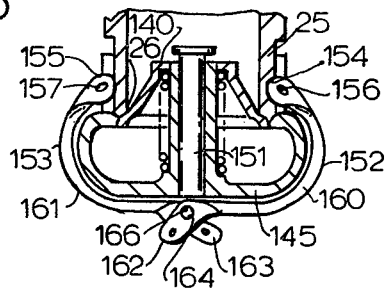
FIG. 8 is a fragmentary view in section of a portion of the by-pass housing, its clamp and the relief valve, taken along the line 8—8 in FIG. 2.

The by-pass housing 145 may be retained in place by suitably adapted standard hardware. For example, there may be a pair of curved latch members 152 and 153, which, as shown in FIG. 8, are pivoted at respective cam portions 154 and 155 to a lug 156 or 157 on the by-pass housing 145. The latch members 152 and 153 have respective curved arms 160 and 161, each with an end 162, 163 having a respective opening 164, 165. The openings 164, 165 are aligned and can be held closed by a pin 166 inserted through them. The upper opening 147 is provided with a cylindrical portion 167 which fits into the cylindrical opening 28 through the valve body 11, and it may be provided with a suitable piston ring 168 to help in the sealing action.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A valve unit for a shipboard storage tank for liquids, for installation in a vent conduit leading from an upper end of said tank to an outlet open to the atmosphere, said valve having a housing with an annular closure seat for said vent conduit and a closure member in said housing for automatically closing against said seat to close the conduit against the passage of fluids from said tank to said outlet, latching means in said housing for normally latching said closure member in open position so as normally not to interfere with venting and overflow functions, and unlatching means in said housing for unlatching said latching means upon said valve reaching a predetermined depth when the ship sinks, said valve unit having in combination therewith:

by-pass means around said closure seat, said by-pass means comprising a by-pass conduit leading from below said closure seat to above said closure seat, and relief valve means in said by-pass conduit, opening only when the pressure below said closure seat is a predetermined amount higher than the pressure above said closure seat.

2. A valve unit for a shipboard storage tank for liquids, for installation in a vent conduit leading from an upper end of said tank to an outlet open to the atmosphere, said valve having a valve housing above said tank and below said vent conduit outlet, said valve housing having an annular closure seat for said vent conduit, a closure member in said housing, and spring means for automatically closing said closure member from below against said seat to prevent the passage of fluids from said tank to said outlet, latching means for normally latching said closure member in open position so as normally not to interfere with venting and overflow functions, and unlatching means for unlatching said latching means upon said outlet reaching a predetermined depth when the ship sinks, said valve unit having in combination therewith:

a first by-pass opening through said valve housing below said closure seat, a second by-pass opening through said valve housing above said closure seat, a by-pass housing providing a conduit leading from said first by-pass opening to said second by-pass opening, a relief valve member in said by-pass housing normally closing said first by-pass opening, and spring means in said by-pass housing for urging said relief valve toward a closed position, so that said relief valve opens only when the pressure below said closure seat is a predetermined amount higher than the pressure above said closure seat.

3. The valve unit of claim 2, wherein said by-pass housing is freely detachable from said valve housing, and locking clamp means pivotally mounted to said valve housing for snugly locking said by-pass housing in place to said valve housing in a first position, and for rendering said by-pass housing freely removable from said valve housing when said clamp is moved to a second position.

4. The valve unit of claim 3, having a latch for locking said valve closure member in its closed position to said valve housing, said latch being carried by said valve closure member and normally held in a non-locking position when said valve closure member is closed, by said latch being engaged by said by-pass housing, said latch being slidable to its closed position, entering said second by-pass opening, when said by-pass housing is removed from said valve housing.

5. The valve unit of claim 4 having spring means urging said latch toward its closed position, whereby upon withdrawal of said by-pass housing, which holds said latch open when in place, said latch is automatically moved to its closed position.

6. In a valve for a shipboard storage tank for liquids, for installation in a vent conduit leading from an upper end of said tank to an outlet open to the atmosphere, said valve having a valve housing containing a closure seat for said conduit and a spring-urged closure member for automatically closing against said seat to prevent the passage of fluids from said tank to said outlet, latching means for normally latching said closure member in open position so as normally not to interfere with venting and overflow functions, and unlatching means for unlatching said latching means upon said outlet reaching a predetermined depth when the ship sinks, the improvement where:

said unlatching means comprises an outer bellows plate, an inner bellows plate closing an opening through said valve housing and having a central opsning therethrough, two concentric bellows sealed to both plates radially beyond said opening, with the annular space between them containing gas at a predetermined reference pressure, a bellows housing spaced away from said bellows and from said outer bellows plate and seated against said inner bellows plate and having a passage leading from the atmosphere into the space surrounding said bellows, said passage including restricted orifice means and a metering pin trapped in and extending through said orifice means and movable freely back and forth within it, said metering pin being moved back and forth by normal movement of a ship on which said valve is installed thereby keeping said orifice means free and accessible to exterior fluids such that an increase in pressure in said space compresses said bellows and urges said outer bellows plate toward said inner bellows plate, and said latching means including trigger means operatively connected to said outer bellows plate for movement therewith and having means for normally engaging said closure member and retaining said closure member in a latched position, said trigger means releasing said closure member when the pessure in said bellows housing exceeds a predetermined amount and thereby moves said trigger means to a release position.

7. A valve unit for a shipboard storage tank for liquids, for installation in a vent conduit leading from an upper end of said tank to an outlet open to the atmosphere said valve comprising a valve body with an inlet from said tank and an outlet to said vent conduit and with a closure seat below said outlet, a closure member having a clapper for engagement with said seat and lever means, a spring-receiving cavity adjacent said clapper, and a trigger-retaining notch, a rotatable clapper-supporting shaft bearinged in said housing and secured to said lever means, whereby said closure member is rotatable with said shaft, a release shaft supported rotatably in said housing and having two semicylindrical portions, each with a flat surface and aligned with each other, on opposite sides of a central tongue, a spring carrier having a head portion providing a shoulder and a pair of parallel walls joined by a transverse member having a slot therethrough engaged by said tongue, and an outboard portion normally seated in said spring-receiving cavity, a spring around said spring carrier bearing against said shoulder and against said clapper in said spring-receiving cavity, a trigger assembly having a trigger with a trigger member normally in its locked position engaging said trigger-retaining notch and flat-sided lugs facing and normally spaced from the flat portions of said release shaft, so as to hold said clapper in open position, actuator means providing a sealed reference chamber having, relative to said valve housing, one stationary end and one movable end, an actuator housing spaced away from and surrounding said actuator means and having a restricted passage leading from the atmosphere into the space surrounding said actuator means, said trigger means being connected to said movable means and moved by it to unlock said closure member when the pressure in said actuator housing exceeds a predetermined value.

8. The valve unit of claim 7 wherein said clapper supporting shaft has a portion extending outside said valve housing and position indicating means on the end thereof, and position interpreting means adjacent thereto on said valve housing exterior.

9. The valve unit of claim 7 wherein said release shaft has a helical key at one end enabling testing the operability of said valve.

* * * * *